US008594519B2

(12) United States Patent
Nakatake et al.

(10) Patent No.: US 8,594,519 B2
(45) Date of Patent: Nov. 26, 2013

(54) IMAGE FORMING APPARATUS AND TONER SUPPLY METHOD

(75) Inventors: Naoki Nakatake, Hyogo (JP); Atsushi Takehara, Kyoto (JP); Tetsumaru Fujita, Hyogo (JP); Tomohiro Kubota, Osaka (JP); Kohta Sakaya, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 13/020,405

(22) Filed: Feb. 3, 2011

(65) Prior Publication Data

US 2011/0194864 A1 Aug. 11, 2011

(30) Foreign Application Priority Data

Feb. 9, 2010 (JP) ..... 2010-026413

(51) Int. Cl.
*G03G 15/08* (2006.01)

(52) U.S. Cl.
USPC ..... 399/27; 399/29; 399/60; 399/61; 399/72; 399/257; 399/359

(58) Field of Classification Search
USPC ..... 399/27, 29, 60, 61, 72, 257, 359
See application file for complete search history.

(56) References Cited

U.S. PATENT DOCUMENTS

| | | | | |
|---|---|---|---|---|
| 6,167,211 | A * | 12/2000 | Oogi et al. | 399/359 |
| 6,360,070 | B1 * | 3/2002 | Taka et al. | 399/301 |
| 7,269,364 | B2 * | 9/2007 | Tanaka et al. | 399/27 |
| 2006/0198644 | A1 * | 9/2006 | Itagaki et al. | 399/27 |
| 2008/0075480 | A1 | 3/2008 | Konishi et al. | |
| 2009/0175638 | A1 * | 7/2009 | Okamoto et al. | 399/46 |
| 2010/0098441 | A1 | 4/2010 | Miyazaki et al. | |
| 2010/0158573 | A1 * | 6/2010 | Sheen | 399/254 |
| 2011/0217055 | A1 | 9/2011 | Takehara et al. | |

FOREIGN PATENT DOCUMENTS

| | | |
|---|---|---|
| JP | 4026977 | 10/2007 |
| JP | 2009-75244 | 4/2009 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A toner supplying method for supplying toner from a toner container to a developing part that causes toner to adhere to a latent image formed on a latent image carrying member and develops the latent image, includes detecting a toner amount in the developing part as being equal to or less than a predetermined toner amount value; forming a fog detecting image in a case where the toner amount in the developing part is equal to or less than the predetermined toner amount value, and detecting fog; and determining based on the detected fog whether to execute a toner ejecting process of ejecting the toner remaining in the developing part toward the latent image carrying member before supplying the toner to the developing part from the toner container.

11 Claims, 8 Drawing Sheets

IMAGE FORMING APPARATUS AND TONER SUPPLY METHOD

BACKGROUND OF THE INVENTION

1. Field of the Invention

The present invention relates to an image forming apparatus and a toner supply method.

2. Description of the Related Art

In the related art, a single-component developing apparatus is known. In the single-component developing apparatus, developing is carried out in such a manner that a developing roller, which is a toner carrying member, carries toner that is developer of a non-magnetic or magnetic single component, and the toner on the developing roller is supplied to a latent image on a photosensitive member, in a developing area in which the photosensitive member that is a latent image carrying member and the developing roller face one another.

In the single-component developing apparatus, the developing apparatus is replaced when the toner in the developing apparatus has run out. Therefore, the developing roller for which a replacement time has not been reached yet and thus usage of which can be continued is also replaced. Thus, a resource may be wasted. In a case where the developing apparatus is configured such that a time at which the toner in the developing apparatus runs out and the replacement time of the developing roller are the same as one another, it may be necessary to ensure a space for holding a great amount of toner in the developing apparatus, and thus, the developing apparatus may be increased in size.

Japanese Patent No. 4026977 (patent document 1) describes an image forming apparatus in which a toner container that holds toner is provided separate from a developing apparatus, and a supplying part supplies the toner of the toner container to the developing apparatus. Thereby, in a case where the toner in the toner container runs out, only the toner container is to be replaced, and thus, a developing roller for which usage can be continued is not to be replaced. Further, because an amount of the new toner held by the toner container may be determined without regard to a replacement time of the developing roller, it is possible to reduce a capacity of the toner container to be small, and thus, it is possible to prevent the image forming apparatus from being increased in size.

Further, according to the image forming apparatus of the patent document 1, the toner of the toner container is supplied to the developing apparatus when the toner amount in the developing apparatus becomes less than a lower limit value. Therefore, after the toner is thus supplied to the developing apparatus, the toner having remained in the developing apparatus for a long period of time without being used for developing and the toner newly supplied from the toner container are mixed together.

Japanese Laid-Open Patent Application No. 2009-75244 (patent document 2) describes the following image forming apparatus for preventing fog caused as a result of new toner being supplied to a developing apparatus in which old deteriorated toner remains. The term "fog" means a phenomenon that an image area that is to be a blank has a density increased as a result of toner adhering thereto through a developing process. That is, when a toner amount in the developing apparatus becomes less than a lower limit value, such control is carried out that, before toner is supplied to the developing apparatus, the toner remaining in the developing apparatus is ejected toward an image carrying member. Thereby, the old toner remaining in the developing apparatus is ejected to the image carrying member, and, in a condition in which the developing apparatus has thus become approximately empty of toner, new toner is supplied from a toner container. Therefore, almost all of the toner in the developing apparatus becomes the new toner after the new toner is thus supplied, and thus, it is possible to prevent fog after the new toner is supplied.

A reason why fog occurs when deteriorated old toner and new toner are mixed will now be described concretely.

Old toner remaining in a developing apparatus has suffered stress for a long period of time due to such as stirring. As a result, an external additive that is added externally to surfaces of toner particles for controlling flowability and an electrification property may have been removed or may have been embedded in the particles. Thereby, the toner may not be easily electrified frictionally to, for example, negative polarity that is normal electrification polarity of the toner. On the other hand, new toner supplied to the developing apparatus is not deteriorated and thus, is easily electrified frictionally to the negative polarity. Therefore, when the new toner that is easily electrified to the negative polarity and the old toner that is not easily electrified to the negative polarity are rubbed together, charge separation occurs, and electrons in the old toner move to the new toner. As a result, an electrification amount of the new toner to the negative polarity may increase, an electrification amount of the old toner to the negative polarity may decrease, or the old toner may be electrified to positive polarity. As a result, the toner electrification distribution becomes broad, and also, such a distribution may occur in which two peaks, i.e., an area in which the electrification amount to the negative polarity is large and an area in which the electrification amount is approximately zero, exist. Thus, after the new toner is supplied, the deteriorated toner may become weak electrified toner, or reverse electrified toner. Therefore, in an image forming process after the new toner is supplied, the above-mentioned deteriorated old toner may adhere to an area (other than a latent image area) on a photosensitive member that is an image carrying member for which area no toner is desired to be placed. As a result, fog increases in comparison to a case before the new toner is supplied.

However, there may be case where, for example, a toner consumption rate per a unit period of time in a developing apparatus is high, remaining toner in the developing apparatus becomes equal to or less than a predetermined value within a short period of time, the toner in the developing apparatus has suffered not much stress, and thus, deterioration of the old toner remaining in the developing apparatus is minor. In such a case where deterioration of the old toner remaining in the developing apparatus is minor, the toner has sufficient electrification capability, so that charge separation hardly occurs even when new toner is supplied and the old toner and the new toner are rubbed together. Therefore, in such a case where deterioration of the old toner remaining in the developing apparatus is minor, a toner electrification distribution in the developing apparatus after the new toner is supplied can be maintained as a sharp distribution having a peak of a predetermined electrification amount of the negative polarity. As a result, it is possible to obtain an image in which fog is prevented after the new toner is supplied.

However, according to the above-mentioned patent document 2, although deterioration of old toner remaining in the developing apparatus is minor, and thus, the toner has sufficient electrification capability, the toner is ejected to the image carrying member, and thus, is discarded. As a result, the toner may be wasted.

SUMMARY OF THE INVENTION

The present invention has been devised in consideration of the above-mentioned problem, and an object of the present invention is to provide an image forming apparatus and a toner supply method in which it is possible to prevent fog after new toner is supplied and also developer is prevented from being wasted.

According to an aspect of the present invention, an image forming apparatus includes a latent image carrying member that carries a latent image; an electrifying part that electrifies a surface of the latent image carrying member; a latent image writing part that writes the latent image on the latent image carrying member; a developing part that develops the latent image on the latent image carrying member by using toner and obtains a toner image; a transferring part that transfers the toner image on the latent image carrying member to a surface of an endless moving member in which the surface is moved in an endless manner or a recording member held on the surface of the endless moving member; a toner container that holds the toner to be supplied to the developing part; a remaining amount detecting part that detects a toner remaining amount in the developing part; a toner supplying part that supplies the toner to the developing part from the toner container when the remaining amount detecting part detects that the toner remaining amount in the toner developing part is equal to or less than a predetermined toner amount value; a fog detecting part that detects fog of an image; and a determining part that, when the remaining amount detecting part detects that the remaining toner amount in the developing part is equal to or less than the predetermined toner amount value, forms a fog detecting image, detecting the fog detecting image by the fog detecting part, and determines, based on a detection result of the fog detecting part for the fog detecting image, whether a toner ejecting process of ejecting the toner remaining in the developing part to the latent image carrying member is carried out before supplying the toner to the developing part by the toner supplying part.

According to another aspect of the present invention, a toner supply method for supplying toner from a toner container to a developing part that causes toner to adhere to a latent image formed on a latent image carrying member and develops the latent image, includes detecting a toner amount in the develop part as being equal to or less than a predetermined toner amount value; forming a fog detecting image in a case where the toner amount in the developing part is equal to or less than the predetermined toner amount value, and detecting fog; and determining based on the detected fog whether to execute a toner ejecting process of ejecting the toner remaining in the developing part toward the latent image carrying member before supplying the toner to the developing part from the toner container.

Other objects, features and advantages of the present invention will become more apparent from the following detailed description when read in conjunction with the accompanying drawings.

DETAILED DESCRIPTION OF THE EMBODIMENTS

According to an embodiment of the present invention, it is determined whether a toner ejecting process is to be carried out, based on a detection result of detection by a fog detecting part. Thereby, it is possible to prevent fog after new toner is supplied, and also, it is possible to prevent developer from being wasted. That is, in a case where fog is equal to or more than a predetermined fog value as a result of the detection by the fog detecting part, toner is supplied to a developing part after the toner ejecting process is carried out. On the other hand, in a case where fog is less than the predetermined fog value as a result of the detection by the fog detecting part, toner is supplied to the developing part without carrying out the toner ejecting process. In a case where deterioration of old toner remaining in the developing part has developed, friction electrification is not sufficiently carried out in the toner, and thereby, fog becomes equal to or more than the predetermined fog value. Therefore, in a case where fog is equal to or more than the predetermined fog value, the toner ejecting process is carried out, old toner remaining in the developing apparatus is thus ejected, and, in a condition in which the inside of the developing apparatus becomes almost empty of toner, new toner is supplied to the developing apparatus. Thereby, it is possible to prevent fog after the new toner is supplied.

On the other hand, in a case where deterioration of the old toner remaining in the developing apparatus is minor and the toner has sufficient friction electrification capability, fog becomes less than the predetermined fog value. Therefore, in this case, the ejecting process is not carried out and new toner is supplied to the developing apparatus. Thereby, it is possible to prevent useless consumption of toner, and also, it is possible to prevent fog after new toner is supplied.

Below, an embodiment of an electrophotographic printer (simply referred to as a printer, hereinafter) as an image forming apparatus according to the present invention will now be described.

Figure 1A:
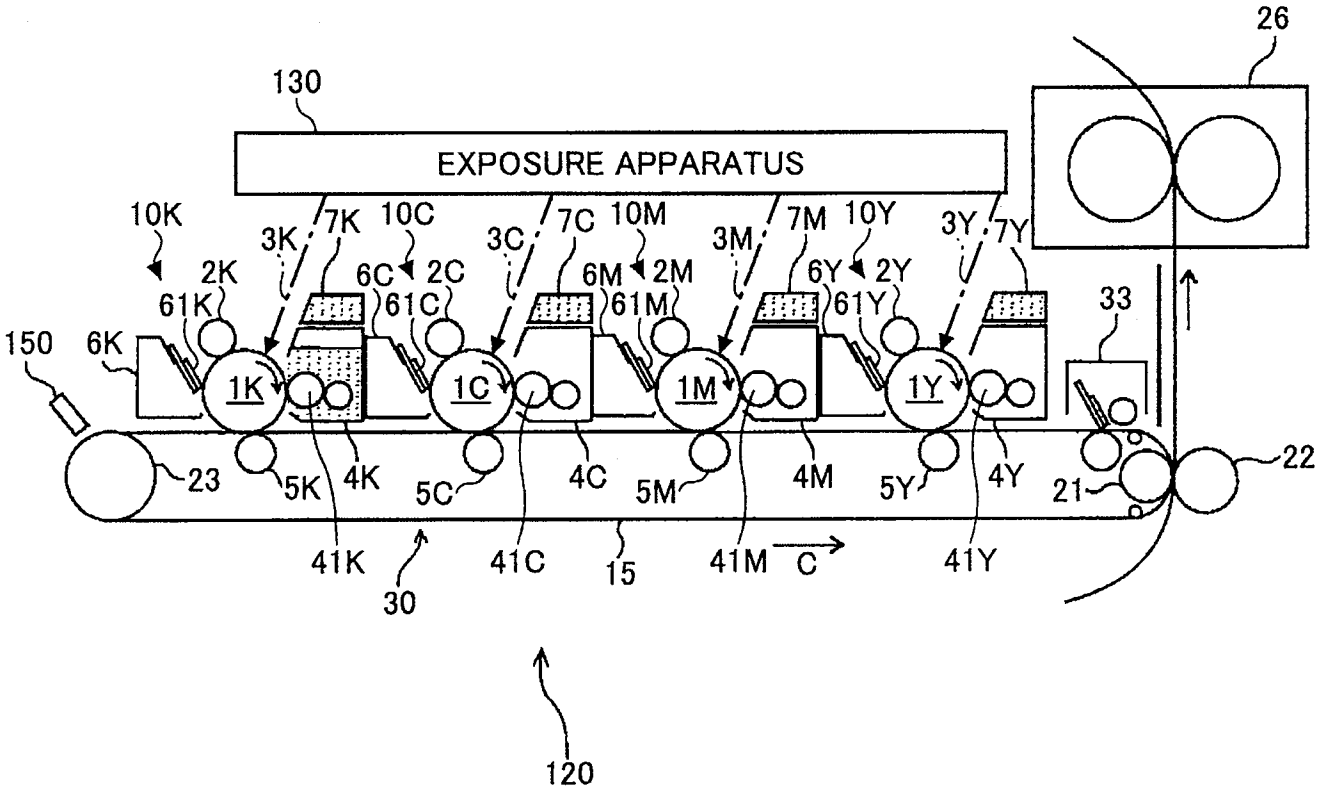
FIG. 1A shows a general partial configuration an image forming part included in a printer according to an embodiment of the present invention.
Figure 1B:
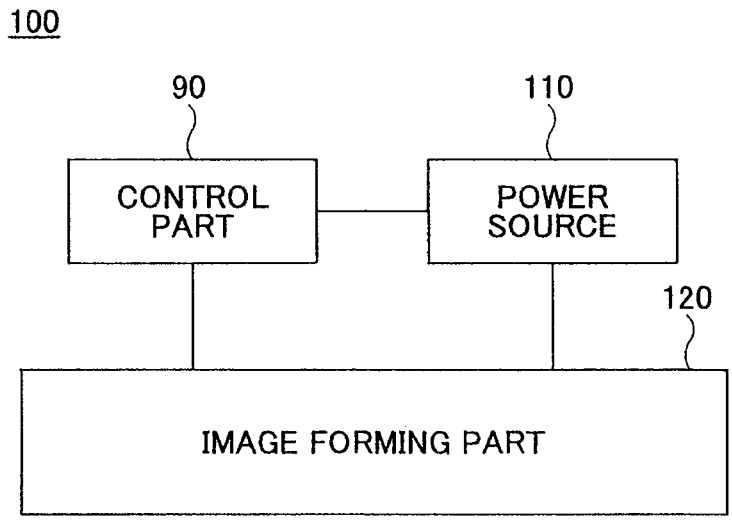
FIG. 1B shows a block diagram showing a relationship between a control part and a power source included in the printer and the image forming part shown in FIG. 1A.
Figure 2:
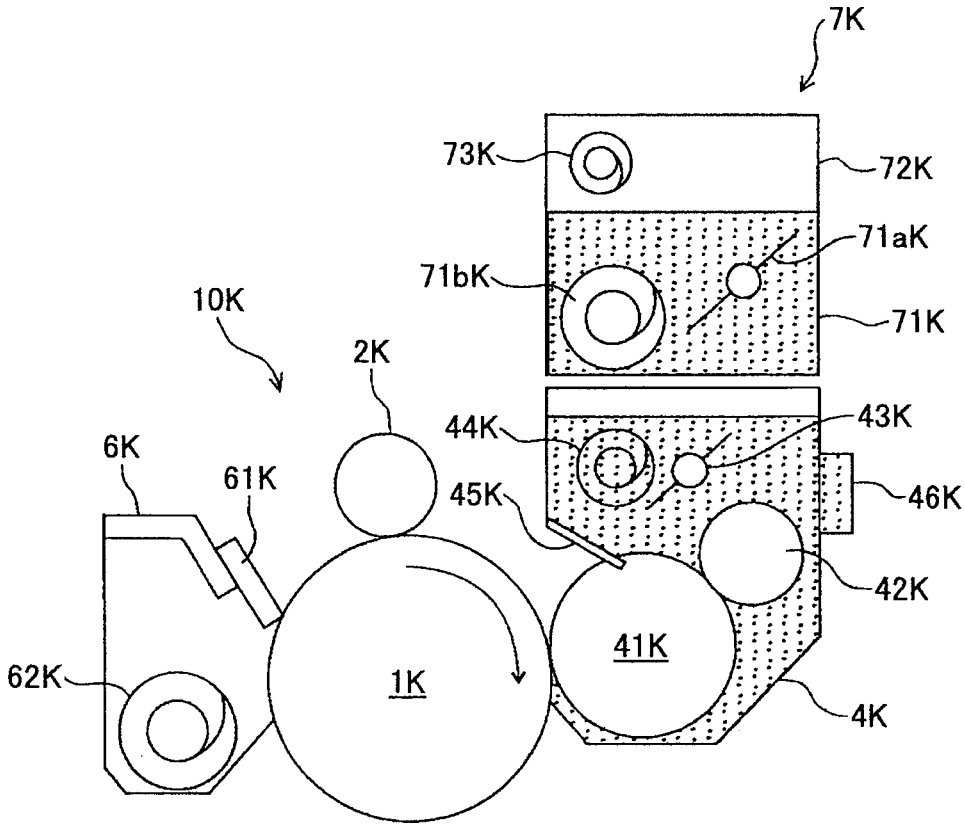
FIG. 2 shows a general configuration of a process cartridge for a color K (black) and parts around it in the printer shown in FIG. 1A.

First, a basic configuration of a printer 100 will now be described. FIG. 1A shows a general partial configuration of an image forming part 120 of the printer 100. In FIG. 1A, the image forming part 120 of the printer 100 includes four process cartridges 10Y, 10M, 10C and 10K for forming yellow, magenta, cyan and black (simply referred to as Y, M, C and K, respectively, hereinafter) toner images, respectively. These four process cartridges 10Y, 10M, 10C and 10K use Y, M, C and K toners of mutually different colors, respectively. Other than this point, these four process cartridges 10Y, 10M, 100 and 10K have the same configurations as each other, and are replaced when they come to the ends of their lives, respectively. FIG. 1B shows a control part 90 and a power source 110 included in the printer 100. The control part 90 controls operations of various parts/components included in the image forming part 120 of the printer 100. The power source 110 supplies power to the various parts/components included in the image forming part 120 of the printer 100. To take the process cartridge 10K for forming a K toner image as an example, as shown in FIG. 2, the process cartridge 10A includes a drum-like photosensitive member 1K as a latent image carrying member, an electrifying apparatus 2K, a developing apparatus 4K and a drum cleaning apparatus 6K as a toner removing part. The process cartridge 10K is detachable from the body of the printer 100, and has such a configuration that consumable parts can be replaced at a time.

The electrifying apparatus 2K as an electrifying part is configured so that a high voltage of a core metal of an electrification roller (2K) which is in contact with a surface of the photosensitive member 1K and thus is rotated along with rotation of the photosensitive member 1K is applied to the surface of the photosensitive member 1K, and the surface of the photosensitive member 1K is uniformly electrified. Instead of the electrification roller (2K), a corotron-type or a scorotron type electrification unit that discharges electricity as a result of a high voltage being applied to a charging wire, an electrification brush, an electrification sheet, a stylus electrode, or such, may be used. These are advantageous in that they can electrify the surface of the photosensitive member 1K in a non-contact manner, and thus, are not easily affected by a cleaning property. However, an amount of discharge product such as ozone, NOx or such generated along with discharging is particularly larger than the case of using the electrification roller, and therefore, a problem may arise concerning durability of the photosensitive member 1K.

The developing apparatus 4K is a single-component developing apparatus, and includes a developing roller 41K as a toner carrying member, and a toner supply roller 42K as a toner supply member that supplies toner to the developing roller 41K. Above the developing apparatus 4K, a toner container 7K is provided. In the toner container 7K are included a toner storage part 71K that stores new toner and a waste toner receiving part 72K that is provided above the toner storage part 71K and receives waste toner. In the toner storage part 71K, an agitator 71*a*K that is driven and rotated by a driving part not shown, and a conveying member 71*b*K that includes a screw or a coil and conveys the new toner from the inside of the toner storage part 71K toward a toner supply port not shown acting as a connection part connecting between the developing apparatus 4K and the toner storage part 71K, are provided. The conveying member 71*b*K is driven and rotated by a driving part not shown. It is preferable that the agitator 71*a*K is at any time driven and rotated to stir the new toner in the inside of the toner storage part 71K for the purpose of maintaining flowability of the new toner in the inside of the toner storage part 71K.

In the developing apparatus 4K, a toner transporting member 44K that includes a screw or such for conveying the new toner of the toner storage part 71K supplied from the toner supply port to the entire area in an axis direction of the developing apparatus 4K, an agitator 43K that stirs toner in the developing apparatus 4K, and the developing roller 41K that is the toner carrying member, are provided. Further, a lamellation blade 45K, an extending end of which is in contact with the developing roller 41K and which makes thinner a toner layer that is carried by the developing roller 41K, and a toner supply roller 42K that is in contact with the developing roller 41K and supplies toner to the developing roller 41K, are provided.

The toner supply roller 42K is in contact with the developing roller 41K, is rotated along with rotation of the developing roller 41K or is rotated in a rotation direction reverse or counter to a rotation direction of the developing roller 41K, and supplies toner that adheres to the toner supply roller 42K to the toner developing roller 41K. The surface of the toner supply roller 42K is coated by a formed material having cells, thus, efficiently takes in by causing the toner in the inside of the developing apparatus 4K to adhere to the formed material, and also, prevents deterioration of the toner otherwise occurring because of concentration of pressure at a part at which the toner supply roller 42K is in contact with the developing roller 41K. To the toner supply roller 42K, a voltage of normal electrification polarity (negative polarity) of toner is applied by the power source 110 as a voltage applying part. The voltage is a negative voltage lower than a voltage (negative voltage) applied to the developing roller 41K, that is, a negative voltage having an absolute value larger than an absolute value of the negative voltage applied to the developing roller 41K. Thereby, at the part at which the toner supply roller 42K is in contact with the developing roller 41K, an electric field is generated. Friction electrification of the toner in the inside of the developing apparatus 4K is promoted as the toner is stirred by the agitator 43K and the toner is electrified in the normal electrification polarity (negative polarity). Thereby, the toner held by the toner supply roller 42K and conveyed to the part at which the toner supply roller 42K is in contact with the developing roller 41K moves from the toner supply roller 42K to the developing roller 41K by the influence of the electric field, and statically adheres to the developing roller 41K. A layer thickness of the K toner adhering to the developing roller 41K on the surface of the developing roller 41K is controlled by the lamellation blade 45K when the K toner on the developing roller 41K passes a position along with rotation of the developing roller 41K at which the developing roller 41K is in contact with the lamellation blade 45K. The K toner, after the layer thickness thereof is thus controlled, adheres to an electrostatic latent image for the color K formed on the photosensitive member 1K for the color K at a developing area that is a part at which the developing roller 41K is in contact with the photosensitive member 1K. As a result of the adhesion, the electrostatic latent image for the color K is developed by the K toner into a K toner image.

Figure 3:
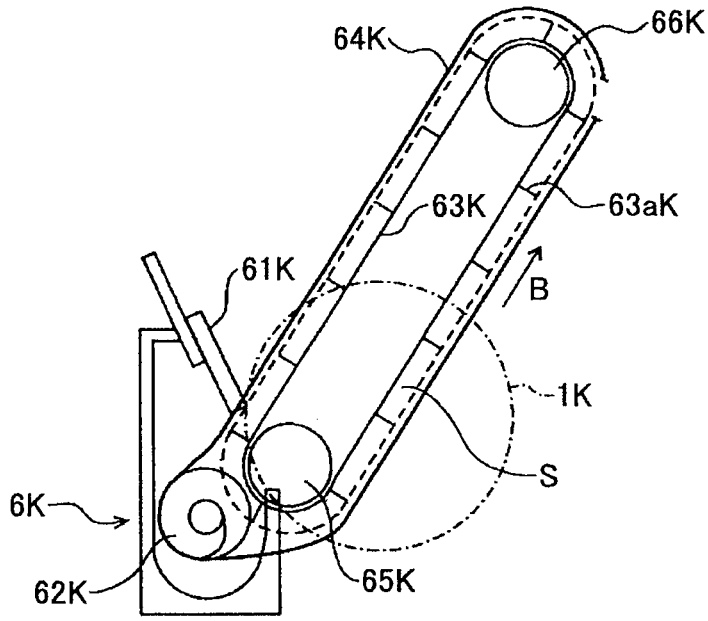
FIG. 3 illustrates a positional relationship between a waste toner collecting belt and other members of the process cartridge for the color K shown in FIG. 2.

FIG. 3 illustrates a positional relationship between a waste toner collecting belt 63K provided in the process cartridge 10K and not shown in FIG. 2 and other members of the process cartridge 10K.

At an end of the process cartridge 10K, a waste toner conveyance part 64K that extends from the drum cleaning apparatus 6K to a waste toner receiving part 72K of the toner container 7K (not shown in FIG. 3) is provided. A bottom end of the waste toner conveyance part 64K communicates with the drum cleaning apparatus 6K and a top end of the waste toner conveyance part 64K communicates with the waste toner receiving part 72K of the toner container 7K. In the inside of the waste toner conveyance part 64K, the endless waste toner collecting belt 63K is provided, and is extended between and wound on a following roller 65K and a driving roller 66K in a tensioned state. On an outer circumferential surface of the waste toner collecting belt 63K, protrusion parts 63*a*K are formed at predetermined intervals. The protrusion parts 63*a*K of the waste toner collecting belt 63K have a width the same as a width of the waste toner collecting belt 63K, and tops of the protrusion parts 63*a*K have heights such that the top surfaces of the protrusion parts 63*a*K touch without gaps a surface of the waste toner conveyance part 64K facing the waste toner collecting belt 63K.

Toner removed from the photosensitive member 1K by the drum cleaning apparatus 6K is, as waste toner, conveyed to the bottom end of the waste toner conveyance part 64K at an end part of the process cartridge 10K, by a waste toner conveying member 62K. The waste toner thus conveyed to the bottom of the waste toner conveyance part 64K is raked up by the protrusion parts 63*a*K of the waste toner collecting belt 63K. The waste toner that has been thus raked up by the protrusion parts 63*a*K is held, as shown in FIG. 3, in a space S between the protrusion parts 63*a*K and a bottom surface of the waste toner conveyance part 64K and is conveyed upward (in a direction indicated by an arrow B). After the waste toner is thus conveyed to an upper part of the waste toner conveyance part 64K by the waste toner collecting belt 63K, the waste toner falls to a waste toner receiving path (not shown). The waste toner thus having fallen to the waste toner receiving path is then conveyed to the waste toner receiving part 72K by a waste toner collecting screw 73K (see FIG. 2). The toner that has been thus received by the waste toner receiving part 72K is not used again for a developing purpose, and is kept stored in the waste toner receiving part 72K.

The toner container 7K is provided detachably from the apparatus body of the developing apparatus 4K, and, after the new toner in the toner storage part 71K runs out, the toner container 7K is removed from the apparatus body of the developing apparatus 4K, and is replaced with another toner container 7K in which new toner is held. At the same time, the waste toner stored in the waste toner receiving part 72K of the toner container 7K is also collected.

Further, the developing apparatus 4K has a detecting window 46K made from transparent material and protruding from a case of the developing apparatus 4K (see FIG. 2).

Figure 4:
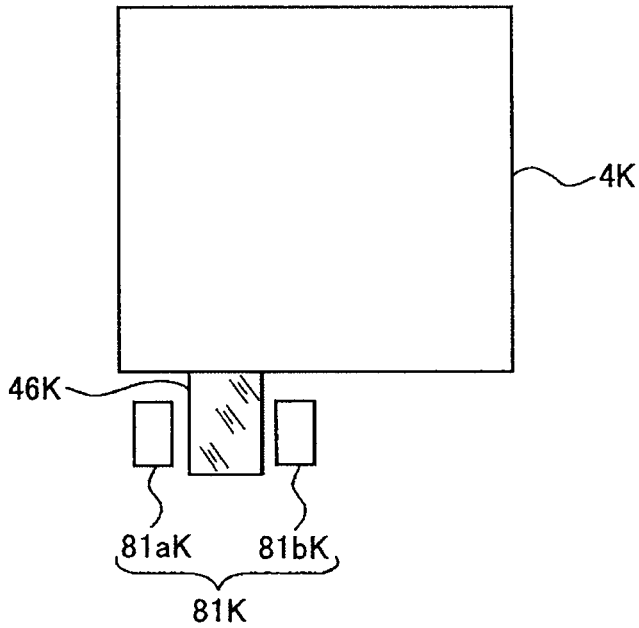
FIG. 4 shows a plan view of a developing apparatus for the color K shown in FIGS. 1 and 2.

FIG. 4 shows a plan view of the developing apparatus 4K. As shown in FIG. 4, a light receiving part 81*a*K and a light emitting part 81*b*K of a transmission optical sensor 81K that is a height detecting part are disposed to face one another to sandwich the detecting window 46K. The detecting window 46K includes a hollow part (not shown), and the hollow part communicates with the inside of the developing apparatus 4K. In a case where a height of the toner held in the developing apparatus 4K is higher than the detecting window 46K, the hollow part of the detecting window 46K is filled with the toner, and light emitted by the light emitting part 81*b*K of the transmission optical sensor 81K is blocked by the toner. Thereby, the light receiving part 81*a*K does not detect light, and an output value of the light receiving part 81*a*K is approximately zero. After the toner in the developing apparatus 4K is consumed, the height of the toner in the developing apparatus 4K I lowered, and the height of the toner in the developing apparatus 4K becomes lower than the position of the detecting window 46K. As a result, since there is no toner in the hollow part of the detecting window 46K, the light emitted by the light emitting part 81*b*K is transmitted by the detecting window 46K and thus is received by the light receiving part 81*a*K. As a result, a predetermined output value is obtained from the light receiving part 81*a*K, and thus, it is detected that the height of the toner held in the developing apparatus 4K becomes equal to or less than a predetermined height value. Thus, the control part 90 detects a toner remaining amount in the developing apparatus 4K. That is, according to the present embodiment, the transmission optical sensor 81K that is the height detecting part and the control part 90 act as a remaining amount detecting part that detects the toner remaining amount in the developing apparatus 4K. According to the present embodiment, the transmission optical sensor 81K is used to detect the toner remaining amount in the developing apparatus 4K based on the height of the toner held in the developing apparatus 4K. However, instead, a piezoelectric sensor or such may be provided in the inside of the developing apparatus 4K, and the toner remaining amount may be detected directly by using the piezoelectric sensor or such provided in the inside of the developing apparatus 4K. The control part 90 is, for example, a computer.

The control part 90 drives and rotates the conveying member 71*b*K (see FIG. 2) after the toner remaining amount becomes less than a predetermined toner amount value, and the new toner is supplied from the toner storage part 71K to the developing apparatus 4K through the process described above with reference to FIG. 2. Thus, the control part 90 and the conveying member 71*b*K act as a toner supply part. Further, the flowability of the toner varies depending on temperature and humidity conditions of the developing apparatus 4K. Therefore, in a case where the conveying member 71*b*K is driven for a fixed driving time period at any time, an amount of the new toner supplied to the developing apparatus 4K may vary depending on the environmental conditions of the developing apparatus 4K. Therefore, it is preferable to change the driving time period of the conveying member 71*b*K based on detection results of temperature and humidity sensors (not shown).

The above-mentioned drum cleaning apparatus 6K includes a cleaning blade 61K, an extending end of which is in contact with the surface of the photosensitive member 1K and which is made of an elastic body, and the waste toner conveying member 62K for conveying the waste toner removed by the cleaning blade 61K from the surface of the photosensitive member 1K to the waste toner conveyance part 64K (see FIG. 3).

The process cartridge 10K has been described above with reference to FIGS. 2, 3 and 4. Each of the process cartridges 10Y, 10M and 10C for the other colors Y, M and C, respectively, has the same configuration as that of the process cartridge 10K for the color K, and Y, M and C toner images are formed on surfaces of the photosensitive members 1Y, 1M and 1C, respectively, by the same processes. Therefore, duplicate descriptions will be omitted.

As shown in FIG. 1A, a transfer unit 30 that is a transferring part and includes an intermediate transfer belt 15 that is an endless moving member is provided below in a vertical direction of the process cartridges 10Y, 10M, 10C and 10K. The intermediate transfer belt 15 is extended between and wound on a tension roller 23 and a driving and secondary transfer facing roller 21 in a tensioned state, and is rotated in a direction of an arrow C shown in FIG. 1A, as the driving and secondary transfer facing roller 21 is driven by a driving motor (not shown) mounted in an extending direction of the driving and secondary transfer facing roller 21. The transfer unit 30 includes, in addition to the intermediate transfer belt 15, four primary transfer rollers 5Y, 5M, 5C and 5K, and a belt cleaning apparatus 33. The transfer unit 30 is configured as being detachable from the body of the printer 100, and is configured such that consumable parts can be replaced at a time.

In this configuration, in a case where image forming is carried out in a negative positive way (in which an absolute value of an electrical potential at an exposed part is lower than an absolute value of an electrical potential at a non-exposed part, and toner adheres to the exposed part), surfaces of the respective photosensitive members 1Y, 1M, 1C and 1K are uniformly electrified by the respective electrifying apparatuses 2Y, 2M, 2C and 2K in negative polarity. Next, from an exposure apparatus 130 as a latent image forming part disposed above in the vertical direction of the photosensitive members 1Y, 1M, 1C and 1K, light 3Y, 3M, 3C and 3K according to given image information is emitted to the respective photosensitive members 1Y, 1M, 1C and 1K, and thereby, latent images of the respective colors are formed on the respective photosensitive members 1Y, 1M, 1C and 1K. As the exposure apparatus 130, a laser beam scanner using laser diodes or such may be used. Next, as a result of developing biases in negative polarity having absolute values larger than the electrical potentials at the exposed parts being applied to the developing rollers 41Y, 41M, 41C and 41K of the respective developing apparatus 4Y, 4M, 4C and 4K from the power source 110, the toners carried by the developing rollers 41Y, 41M, 41C and 41K are moved to the latent images on the photosensitive members 1Y, 1M, 1C and 1K, and are made to adhere to the latent images. Thereby, toner images corresponding to the latent images are formed on the photosensitive members 1Y, 1M, 1C and 1K.

The toner images of the respective colors thus developed by the developing apparatuses 4Y, 4M, 4C and 4K, respectively, are primarily transferred to the intermediate transfer belt 15 as an intermediate transfer member, in such a manner that the respective toner images are superposed to form a color image. The toners not having been transferred to the intermediate transfer belt 15 and remaining after the transfer process on the respective photosensitive members 1Y, 1M, 1C and 1K are removed from the surfaces of the photosensitive members 1Y, 1M, 1C and 1K by cleaning belts 61Y, 61M, 61C and 61K of the respective cleaning apparatuses 6Y, 6M, 6C and 6K.

Further, a paper supply cassette (not shown) is provided below in the vertical direction of the intermediate transfer belt 15 in the printer 100. Transfer paper fed from the paper supply cassette is conveyed by a conveyance belt (not shown) as being guided by a conveyance guide (not shown), and is sent to a temporary stopping position at which a registration roller (not shown) is provided. Then, at a predetermined timing, the transfer paper is supplied by the registration roller to a secondary transfer part between a part of the intermediate transfer belt 15 at which the intermediate transfer belt 15 is wound on the secondary transfer facing roller 21 and a secondary transfer roller 22. Then, as a result of a predetermined secondary bias being applied to the secondary transfer roller 22 by the power source 110, the color image (toner images) formed on the intermediate transfer belt 15 is secondarily transferred to the transfer paper, and the color image is thus formed on the transfer paper. The color image (toner images) formed on the transfer paper is fixed by a fixing unit 26, and after that, the transfer paper is ejected to a paper ejecting tray (not shown). Further, the toners remaining on the intermediate transfer belt 15 after the secondary transfer process are removed by the belt cleaning apparatus 33. The toners thus removed by the belt cleaning apparatus 33 are, as waste toners, conveyed to a waste toner receiving part (not shown and corresponding to the waste toner receiving part 72K of the toner container 7K) of the toner container 7Y from the belt cleaning apparatus 33, through a conveyance part not shown.

Further, the printer 100 has a contact/apart mechanism 50 as a contact/apart part which causes the intermediate transfer belt 15 to come into contact with and be removed from the photosensitive members 1Y, 1M and 1C.

Figure 5A:
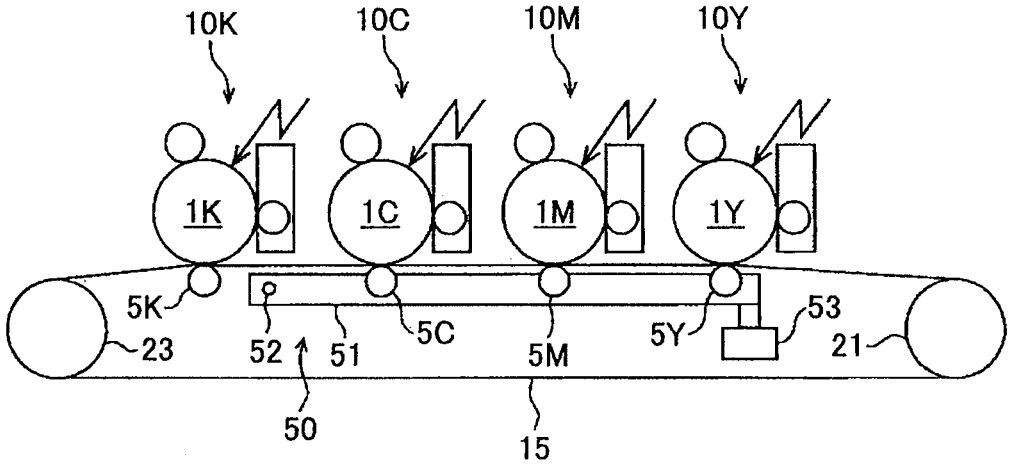
FIGS. 5A and 5B show a general configuration of a contact/apart mechanism in the printer of the embodiment of the present invention.
Figure 5B:
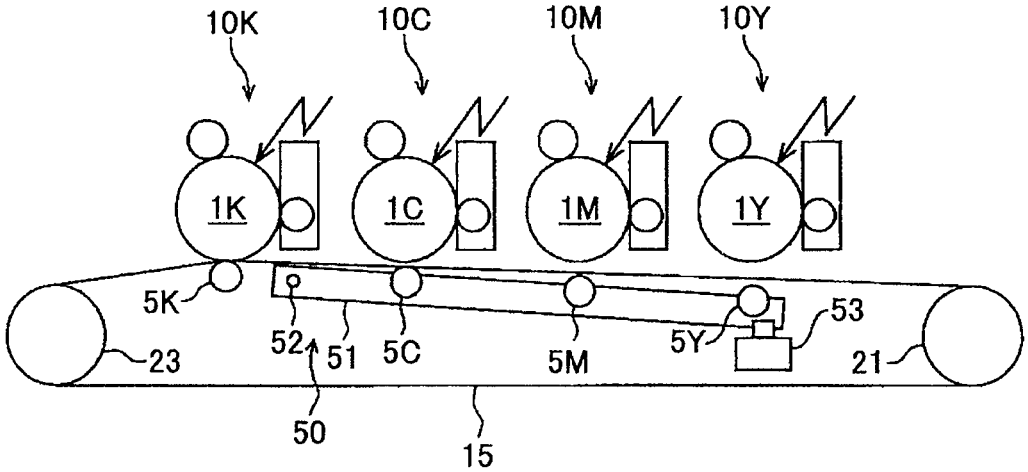

FIGS. 5A and 5B show a general configuration of the contact/apart mechanism 50.

As shown in FIGS. 5A and 5B, the contact/apart mechanism 50 has a pivoting member 51 that supports the primary transfer rollers 5Y, 5M and 5C, one end of the pivoting member 51 being supported in a pivotable manner by a rotation shaft 52. The other end of the pivoting member 51 is supported by a solenoid 53, and, as being driven by the solenoid 53, the pivoting member 51 slightly rotates clockwise in FIGS. 5A, 5B. In a case where a monochrome image is formed, as being driven by the solenoid 53, the pivoting member 51 is slightly rotated clockwise. By the rotating, as shown in FIG. 5B, the intermediate transfer belt 15 is removed from the photosensitive members 1Y, 1C and 1M for the colors Y, C and M. Then, only the process cartridge 10K for the color K is driven from among the four process cartridges 10Y, 10M, 10C and 10K, and a monochrome image is formed. Thus, in cases of forming monochrome images, it is possible to avoid uselessly driving the process cartridges for the colors Y, C and M, and it is possible to prevent the process carriages for the colors Y, C and M from being expended.

Below, for the sake of convenience, description will be made only for the developing apparatus 4K for example. However, also to the other developing apparatuses 4Y, 4M and 4C, the same description is applicable, and duplicate description will be omitted. In the present embodiment, when a toner remaining amount in the developing apparatus 4K becomes less than the predetermined toner amount value, the conveying member 71*b*K (see FIG. 2) supplies new toner to the developing apparatus 4K from the toner storage part 71K. Therefore, in the developing apparatus 4K, the supplied new toner and old toner not having been used for a developing process and having remained in the developing apparatus 4K are mixed. The old toner has suffered stress such as being stirred for a long period of time, and an external additive such as an electrification control agent added externally to surfaces of toner particles for controlling the electrification property may have been removed or may have become embedded in the particles. Thus, the old toner may be deteriorated. The deteriorated old toner may not be easily electrified by friction. On the other hand, the new toner supplied to the developing apparatus 4K is not deteriorated and thus, is easily electrified by friction. When the new toner that is easily electrified to negative polarity and the old toner that is not easily electrified to negative polarity are rubbed together, charge separation occurs, and electrons in the old toner move to the new toner. As a result, an electrification amount of the new toner in negative polarity may increase, an electrification amount of the old toner may decrease, or the old toner may be electrified to positive polarity. Thus, when the new toner is supplied in a condition in which the old deteriorated toner remains in the developing apparatus 4K, the toner electrification distribution in the developing apparatus 4K may become broad, and also, such a distribution may occur in which two peaks, i.e., an area in which the electrification amount is large and an area in which the electrification amount is approximately zero, exist. Then, when the weak-electrified and deteriorated old toner is used for a developing process after the new toner is supplied, the above-mentioned deteriorated old toner may adhere to an area (other than a latent image area) on a photosensitive member that is an image carrying member for which area no toner is desired to be placed (non latent image area), the toner may thus adhere to a background part of an image in a punctiform manner, and thus, fog may occur.

Therefore, in the related art, before new toner is supplied to a developing apparatus from a toner storage part, a toner ejecting process of ejecting old toner remaining in the developing apparatus to a photosensitive member is carried out.

It is noted that, in a case where deterioration of old toner remaining in the developing apparatus is minor, the old toner has a property such that the toner is sufficiently electrified to negative polarity, and therefore, charge separation does not easily occur even when the old toner and new toner are rubbed together. Therefore, in such a case where deterioration of the old toner remaining in the developing apparatus is minor, a toner electrification distribution in the developing apparatus after the new toner is supplied can be maintained as a sharp distribution having a peak of a predetermined electrification amount. Therefore, in a case where deterioration of old toner remaining in the developing apparatus is minor, it is possible to obtain a satisfactory image in which no fog occurs even after new toner is supplied.

However, according to the related art, although deterioration of old toner remaining in the developing apparatus is minor, the toner is ejected to the image carrying member, and thus, is discarded. As a result, the toner may be wasted. Therefore, according to the present embodiment, when a remaining toner amount in the developing apparatus becomes less than the predetermined toner amount value, fog in an image is detected. Then, in a case where detected fog is equal to or more than a predetermined fog amount, a toner ejecting process is carried out. Then, after that, new toner is supplied to the developing apparatus. On the other hand, in a case where detected fog is less than the predetermined fog amount, no toner ejecting process is carried out, and new toner is supplied to the developing apparatus. Below, this point of the present embodiment will be described concretely.

Figure 6:
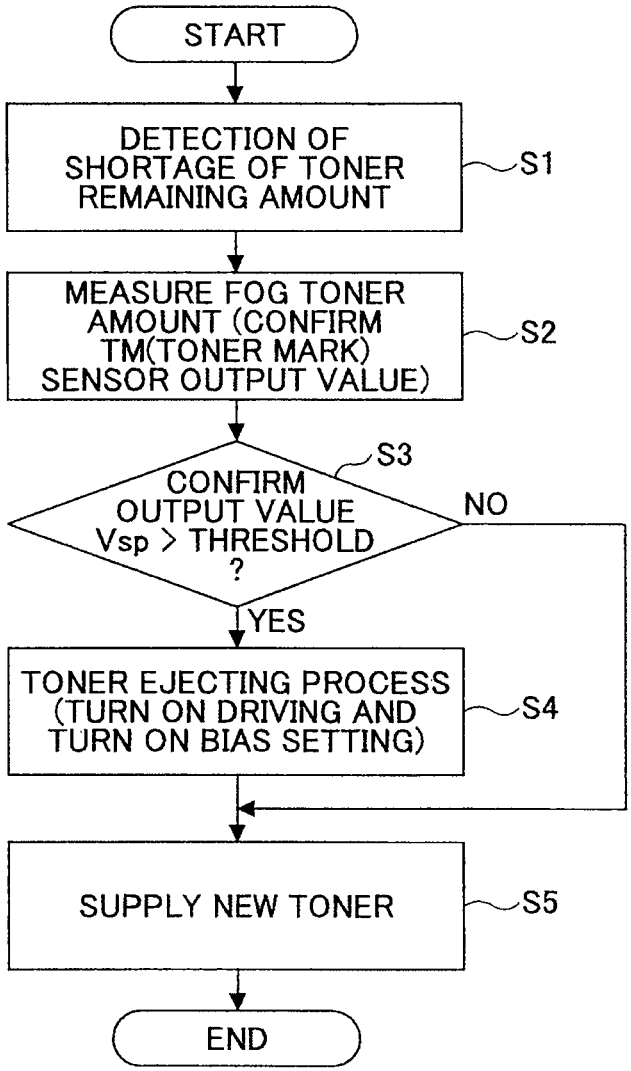
FIG. 6 shows a flowchart of a toner supply control flow in the printer of the embodiment of the present invention.

FIG. 6 shows a flowchart of a toner supply control flow according to the present embodiment.

As mentioned above, for the sake of convenience, description is made only for the developing apparatus 4K for example. However, also to the other developing apparatuses 4Y, 4M and 4C, the same description is applicable, and duplicate description is omitted. As shown in FIG. 6, when the control part 90 has detected based on an output signal of the transmission optical sensor 81K (see FIG. 4) that a toner remaining amount in the developing apparatus 4K is less than the predetermined toner amount value (step S1), the control part 90 carries out a fog detecting process (step S2).

When the fog detecting process is thus carried out, a blank paper image as a fog detecting image is formed on the intermediate transfer belt 15. Specifically, in a case where the toner remaining amount in the developing apparatus 4K for the color K becomes less than the predetermined toner amount value, the electrifying apparatus 2K of the process cartridge 10K including the developing apparatus 4K uniformly electrifies the surface of the photosensitive member 1K, no exposure is carried out by the exposure apparatus 130, and the predetermined developing bias is applied to the developing roller 41K. Thereby, a blank paper image is formed on the photosensitive member 1K. In a case where deterioration of old toner remaining in the developing apparatus 4K is minor, and the old toner is sufficiently electrified, the toner hardly moves to the photosensitive member 1K, and fog hardly occurs. On the other hand, in a case where toner in the developing apparatus 4K is deteriorated, and an electrification amount in the toner is small, a force operating on the toner such that the toner is prevented from moving from the developing roller 41K because of an electric field between the developing roller 41K and the photosensitive member 1K, becomes weaker. Therefore, the deteriorated weak-electrified toner adheres to the photosensitive member 1K. As a result, fog in the blank paper image becomes worse. Then, the blank paper image is transferred to the intermediate transfer belt 15, and the blank paper image is then detected by the reflection optical sensor 150 disposed on the downstream side in the moving direction of the intermediate transfer belt 15 with respect to the process cartridge 10K for the color K as shown in FIG. 1A, and the control part 90 detects fog based on a detection result of the reflection optical sensor 150. That is, the reflection optical sensor 150 and the control part 90 act as a fog detecting part.

Figure 7:
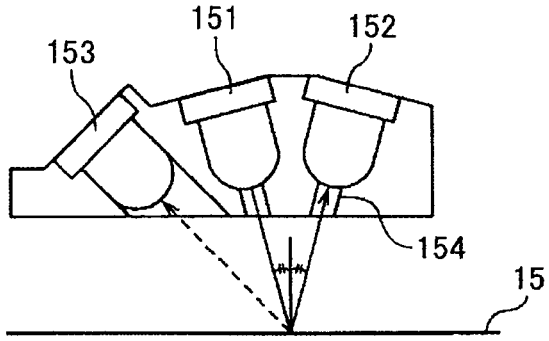
FIG. 7 shows a general configuration of a reflection-type optical sensor in the printer of the embodiment of the present invention.

FIG. 7 shows a general configuration of the reflection optical sensor 150. The reflection optical sensor 150 includes a light emitting device (LED: light emitting diode) 151, a specular reflection light receiving device 152 made of a phototransistor that receives specular reflection light and a diffuse reflection light receiving device 153 made of a phototransistor that receives diffuse light. The specular reflection light receiving device 152 is disposed symmetrically with the light emitting device 151 with respect to a vertical surface. An aperture 154 is provided in front of the specular reflection light receiving device 152 for avoiding receiving diffuse light as much as possible. The diffuse reflection light receiving device 153 is disposed on the opposite side of the specular reflection light receiving device 152 with respect to the light emitting device 151.

By using the reflection optical sensor 150, it is possible to detect a toner adhesion amount on the intermediate transfer belt 15. Specifically, the surface of the intermediate transfer belt 15 is so smooth as to behave as a mirror surface, and therefore, specular reflection light is dominant in light obtained from being emitted by the light emitting device 151 and then being reflected by the surface of the intermediate transfer belt 15. On the other hand, a part at which toner adheres to the intermediate transfer belt 15 has a coarse surface, and therefore, diffuse reflection light becomes dominant over specular reflection light. Accordingly, by measuring a ratio between specular reflection light and diffuse reflection light reflected by the intermediate transfer belt 15, it is possible to estimate a toner adhesion amount by estimating a ratio between an area in which toner adheres and an area in which no toner adheres (bare or exposed surface area) on the intermediate transfer belt 15.

To the specular reflection light receiving device 152 of the reflection optical sensor 150, reflected light (specular reflection) from the surface of the intermediate transfer belt 15 and reflected light (diffuse reflection) from the toner surface are given. To the diffuse reflection light receiving device 153 of the reflection optical sensor 150, reflected light (diffuser reflection) from the surface of the intermediate transfer belt 15 and reflected light (diffuse reflection) from the toner surface are given. Output of the specular reflection light receiving device 152 becomes maximum at a bare surface part of the intermediate transfer belt 15 and decreases as the toner adhesion amount increases. Output of the diffuse reflection light receiving device 153 becomes minimum at the bare surface part of the intermediate transfer belt 15 and increases as the toner adhesion amount increases.

When a blank paper image having a little fog is detected by the reflection optical sensor 150, the output value of the specular reflection light receiving device 152 is approximately maximum and the output value of the diffuse refection light receiving device 153 becomes approximately minimum, since toner hardly adheres to the intermediate transfer belt 15. On the other hand, when a blank paper image having remarkable fog is detected by the reflection optical sensor 150, the output value of the specular refection light receiving device 152 decreases and the output value of the diffuse refection light receiving device 153 increases, since much toner (weak-electrified toner) adheres to the intermediate transfer belt 15.

In the present embodiment, the control part 90 determines whether the output value Vsp of the diffuse light receiving device 153 exceeds a threshold when detecting in the blank paper image that is the fog detecting image (step S3 in FIG. 6). Then, when the output value Vsp of the diffuse light receiving device 153 exceeds the threshold (step S3 YES), the control part 90 determines that fog exceeds the predetermined fog value, and caries out a toner ejecting process (ejecting process mode) (step S4). That is, the control part 90 acts as a determining part.

When the toner ejecting process is carried out, the electrifying apparatus 2K uniformly electrifies the surface of the photosensitive member 1K, and the exposure apparatus 130 exposes the entire surface of the photosensitive member 1K. Thereby, the old toner remaining in the developing apparatus 4K adheres to the entire area of an image forming area of the photosensitive member 1K, and thus, it is possible to effectively eject the toner remaining in the developing apparatus 4K to the photosensitive member 1K. The old toner thus having been ejected to the surface of the photosensitive member 1K is transferred to the intermediate transfer belt 15, and is removed by the belt cleaning apparatus 33 from the intermediate transfer belt 15. Then, the toner is conveyed to the waste toner receiving part of the toner container 7Y of the color Y as waste toner by the conveyance part from the belt cleaning apparatus 33. It is noted that, at this time, the secondary transfer roller 21 is caused to be apart from the intermediate transfer belt 15.

Further, such a control method may be used that the voltage applied to the electrifying apparatus 2K is turned off, the surface of the photosensitive member 1K is not electrified, and the old toner remaining in the developing apparatus 4K is ejected. In this control method, the electrification electric potential on the surface of the photosensitive member 1K is zero and the predetermined developing bias of negative polarity is applied to the developing roller 41K. Therefore, between the photosensitive member 1K and the developing roller 41K, toner of negative polarity on the developing roller 41K electrostatically moves to the photosensitive member 1K. Thus, also in this control method, it is possible that the old toner remaining in the developing apparatus 4K adheres to the entire surface of the image forming area of the photosensitive member 1K. Further, in the case where the control method is used, it is not necessary to expose the surface of the photosensitive member 1K for a long time by the exposure apparatus 130, and it is advantageous that deterioration of the photosensitive member 1K because of light-induced fatigue can be avoided.

Further, such a control method may be used that at a time of carrying out the toner ejecting process, the power source 110 is controlled so that such a voltage is applied to the toner supply roller 42K that an absolute value of the voltage applied to the toner supply roller 42K becomes larger, and an electric potential difference between the developing roller 41K and the toner supply roller 42K becomes larger. Thereby, the old toner remaining in the developing apparatus 4K easily moves to the developing roller 41K from the toner supply roller 42K electrostatically. Further, the lamellation blade 45K may be made to be apart from the developing roller 41K. Thereby, a toner layer on the developing roller 41K becomes thicker, and thus, it is possible to move the toner from the developing apparatus 4K to the photosensitive member 1K within a shorter time period.

The toner ejecting process is terminated in such a manner that, by using the reflection optical sensor 150, a toner density of an image (referred to as an ejected image, hereinafter) formed by the toner ejected from the developing apparatus 4K and transferred to the surface of the intermediate transfer belt 15 is detected, and when the detected toner density of the ejected image becomes equal to or less than a predetermined toner density value because of lack of a toner amount remaining in the developing apparatus 4K, the developing bias is turned off, and the toner ejecting process is terminated. However, in this case, since the position at which the detection is carried out by the reflection optical sensor 150 is to the downstream side in the image moving direction with respect to the developing area, the toner ejecting process is continued for a predetermined time period under the condition of the lack of the toner amount remaining in the developing apparatus 4K. As a result, a time period required for the toner on the intermediate transfer belt 15 being completely removed by the cleaning apparatus 33 becomes longer, and deterioration between the members which rub one another such as rubbing between the photosensitive member 1K and the intermediate transfer belt 15 may cause anxiety. Therefore, because a toner consumption amount per unit time period during the toner ejecting process and a toner remaining amount in the developing apparatus 4K at a time when the toner ejecting process is started are previously known, such a control method may be used that an apparatus driving time is previously calculated therefrom and is stored in a memory (not shown), and, the toner ejecting process is terminated when the apparatus driving time is reached after the toner ejecting process is started. Thereby, the toner ejecting process is terminated at an expected time when the toner density at the developing area becomes equal to or less than the predetermined toner density value. Therefore, it is possible to shorten the time period required for the toner on the intermediate transfer belt 15 being removed in comparison with the case where the toner ejecting process is terminated when the decrease in the toner density of the ejected image transferred to the surface of the intermediate transfer belt 15 is detected by the reflection optical sensor 150. Thereby, it is possible to reduce rubbing between the photosensitive member 1K and the intermediate transfer belt 15 in comparison with the case where the toner ejecting process is terminated when the decrease in the toner density of the ejected image transferred to the surface of the intermediate transfer belt 15 is detected by the reflection optical sensor 150, and thus, it is possible to reduce deterioration between the members that rub one another.

Then, after the toner ejecting process is thus terminated and the toner of the ejected image on the intermediate transfer belt 15 is removed by the belt cleaning apparatus 33, new toner is supplied from the toner storage part 71K to the developing apparatus 4K (step S5). Thus, before the new toner is thus supplied, almost all of the old deteriorated toner in the developing apparatus 4K has been removed through the toner ejecting process, and therefore, it is possible to prevent fog from occurring in a formed image after new toner is supplied.

On the other hand, in a case where the output value Vsp of the diffuse light receiving device 153 is equal to or less than the threshold (step S3 NO), the control part 90 determines that fog is equal to or less than the predetermined fog value, and therefore, does not carry out the toner ejecting process, and supplies new toner to the developing apparatus 4K from the toner storage part 71K (step S5). Thus, in a case where deterioration of the toner remaining in the developing apparatus 4K is minor, and fog hardly occurs, the toner ejecting process is not carried out, and therefore, it is possible to avoid useless toner consumption.

Description has been made for the developing apparatus 4K for the color K for example. As mentioned above, the same toner supply control of FIG. 6 is carried out also for each of the other developing apparatuses 4Y, 4M and 4C for the other colors Y, M and C.

Further, in the above-mentioned configuration, the toner supply control of FIG. 6 is carried out in such a manner that when the toner height in the developing apparatus 4K detected by the transmission optical sensor 81K becomes less than the predetermined height value, it is determined that the toner remaining amount in the developing apparatus 4K becomes less than the predetermined toner amount value (step S1 of FIG. 6). However, there may be a case, depending on the position at which the transmission optical sensor 81K is disposed, where sufficient toner remains in the developing apparatus 4K even when the toner height in the developing apparatus 4K becomes less then the predetermined height value. In this case, the control part 90 starts counting dots included in an image to be output by using the process cartridge 10K since the toner height in the developing apparatus 4K detected by the transmission optical sensor 81K becomes less than the predetermined height value, and estimates a toner consumption amount from the thus-counted number of dots. Then, such a control method may be used that, when the number of dots (toner consumption amount) becomes a predetermined number value, the control part 90 determines that the toner remaining amount in the developing apparatus 4K becomes less than the predetermined toner amount value (step S1 of FIG. 6), in the toner supply control of FIG. 6. Thereby, in comparison to the case where it is determined that the toner remaining amount in the developing apparatus 4K becomes less than the predetermined toner amount value when the toner height in the developing apparatus 4K detected by the transmission optical sensor 81K becomes less than the predetermined height value, it is possible to proceed with the toner supply control (to step S2 of FIG. 6) at a time when the toner remaining amount in the developing apparatus 4K becomes smaller. Therefore, it is possible to reduce a toner amount to be ejected in the toner ejecting process in comparison to the case where it is determined that the toner remaining amount in the developing apparatus 4K becomes less than the predetermined toner amount value when the toner height in the developing apparatus 4K detected by the transmission optical sensor 81K becomes less than the predetermined height value, and thus, it is possible to reduce useless toner consumption.

Figure 10A:
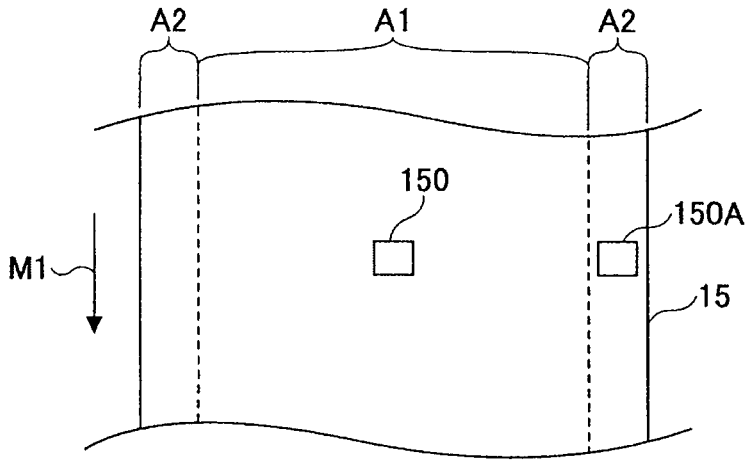
FIGS. 10A and 10B show arrangements of transmission optical sensors.

Further, a gloss level on the surface of the intermediate transfer belt 15 may vary as a result of the surface of the intermediate transfer belt 15 being deteriorated because of having been used for a long time period. When the gloss level on the surface of the intermediate transfer belt 15 varies, the output value of the reflection optical sensor 150 varies, and precise fog detection may not be able to be carried out. Therefore, a second reflection optical sensor 150A (see FIG. 10A) may be provided at a position facing an image not-forming area (A2 in FIG. 10A) of the intermediate transfer belt 15, and the fog detection result of the reflection optical sensor 150 may be corrected by using an output value of the second reflection optical sensor 150A. Specifically, a difference value between a value Vsp_dif' obtained when the second reflection optical sensor 150A detects in the image not-forming area A2 at an edge part of the intermediate transfer belt 15 and a value Vsp_dif obtained when the reflection optical sensor 150 detects in the blank paper image is calculated. Then, when an absolute value of the difference value (Vsp_dif'−Vsp_dif) exceeds a threshold, it is determined that the fog exceeds the predetermined fog value, and the toner ejecting process is carried out. Thus, it is possible to carry out precise fog detection through aging.

Further, in a case where the toner ejecting process for the developing apparatus 4K of the color K is carried out, the photosensitive members 1Y, 1M and 10 of the colors Y, M and C are made to be apart from the intermediate transfer belt 15 by means of the contact/apart mechanism 50 (see FIGS. 5A, 5B). Thereby, in the toner ejecting process of the developing apparatus 4K, the photosensitive members 1Y, 1M and 1C of the colors Y, M an C do not rub on the intermediate transfer belt 15, and thus, it is possible to avoid deterioration of the photosensitive members 1Y, 1M and 1C otherwise occurring because of rubbing and to avoid deterioration of the intermediate transfer belt 15 otherwise occurring because of rubbing. Further, also in a case where the toner ejecting process for each of the developing apparatuses 4Y, 4M and 4C of the colors Y, M and C is carried out, the photosensitive members 1Y, 1M and 1C of the colors Y, M and C are made to be apart from the intermediate transfer belt 15 by means of the contact/apart mechanism 50. In this case, driving of the intermediate transfer belt 15 is stopped, and, the toner ejected from each of the developing apparatuses 4Y, 4M and 4C is not transferred to the intermediate transfer belt 15, is conveyed to the respective one of the drum cleaning apparatuses 6Y, 6M and 6C, and is removed by the drum cleaning apparatus. Thereby, also in a case where the toner ejecting process is carried out for each of the developing apparatuses 4Y, 4M and 4C, the photosensitive members 1Y, 1M and 1C of the colors Y, M an C do not rub on the intermediate transfer belt 15, and thus, it is possible to avoid deterioration of the photosensitive members 1Y, 1M and 1C otherwise occurring because of rubbing and to avoid deterioration of the intermediate transfer belt 15 otherwise occurring because of rubbing.

Further, a second contact/apart mechanism may be provided by which the intermediate transfer belt 15 can be apart from and come into contact with the photosensitive member 1K of the color K. The second contact/apart mechanism includes a supporting member that supports the primary transfer roller 5K of the color K and moves the primary transfer roller 5K in directions of causing the primary transfer roller 5K to be apart from and come into contact with the photosensitive member 1K, and a moving part such as a solenoid or such to move the supporting member in the directions of causing the primary transfer roller 5K to be apart from and come into contact with the photosensitive member 1K. By the configuration, it is possible that at a time of the toner ejecting process for the developing apparatus 4K of the color K, the intermediate transfer belt 15 is made to be apart from the photosensitive member 1K. Thereby, it is possible that driving of the intermediate transfer belt 15 is stopped, and the toner ejected from the developing apparatus 4K is not transferred to the intermediate transfer belt 15, but is conveyed to the drum cleaning apparatuses 6K, and is removed by the drum cleaning apparatus 6K. Thereby, it is possible to avoid deterioration of the intermediate transfer belt 15. Further, in a case of configuring as described above so that all the photosensitive members 1Y, 1M, 1C and 1K can be apart from and come into contact with the intermediate transfer belt 15, and the toner ejected by each of the developing apparatuses 4Y, 4M, 4C and 4K is collected by the respective one of the drum cleaning apparatuses 6Y, 6M, 6C and 6K, the mechanism for causing the secondary transfer roller 22 to be apart from and come into contact with the intermediate transfer belt 15 is not necessary.

Further, in the fog detection, the intermediate transfer belt 15 is made to be apart from the photosensitive member 1K in the example of the toner supply control of the developing apparatus 4K for the color K, after the blank paper image is formed on the intermediate transfer belt 15. Then, after the blank paper image on the intermediate transfer belt 15 is detected by the reflection optical sensors 150, an area of the intermediate transfer belt 15 after being apart from the photosensitive member 1K (which area has moved as passing the belt cleaning apparatus 33 and after that, not coming into contact with the photosensitive member 1K) is detected by the reflection optical sensor 150. This area has not come into contact with the photosensitive member 1K and thus, no toner adheres to the area of the intermediate transfer belt 15. Therefore, it is possible to precisely detect a variation, if any, of the gloss level of the surface of the intermediate transfer belt 15 by detecting the area by the reflection optical sensor 150. A difference value (Vsp_dif'−Vsp_dif) is calculated between the value Vsp_dif obtained when the reflection optical sensor 150 detects the blank paper image and the value Vsp_dif' obtained when the reflection optical sensor 150 detects the above-mentioned area of the intermediate transfer belt 15 after being apart from the photosensitive member 1K. Then, in a case where an absolute value of the difference value (Vsp_dif'−Vsp_dif) exceeds a threshold, it is determined that fog exceeds the predetermined fog value, and the toner ejecting process is carried out. Also by such a control method, it is possible to carry out precise fog detecting through aging. Further, in this control method, it is possible to precisely detect a variation in the gloss level on the surface of the intermediate transfer belt 15 merely by providing the reflection optical sensor 150 at the image forming area (A1 in FIG. 10A).

Figure 10B:
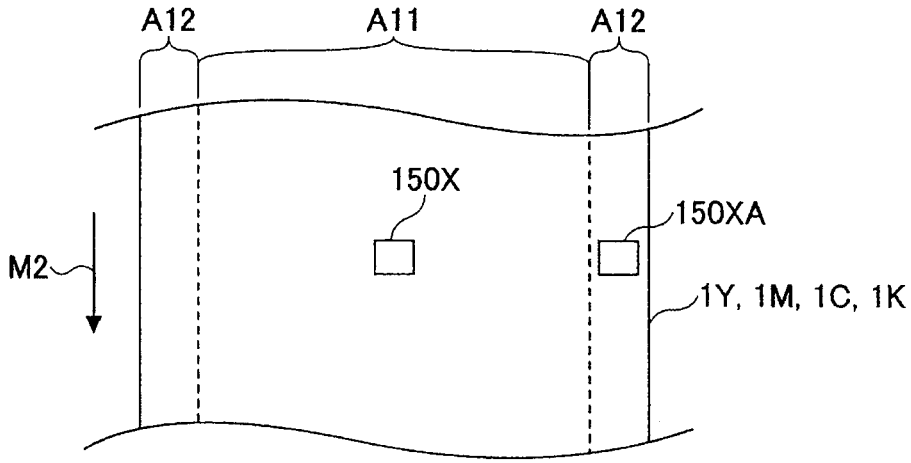

Further, in the above description, the reflection optical sensor 150 is provided at a position facing the immediate transfer belt 15. However, instead, as shown in FIG. 10B, a reflection optical sensor 150X, corresponding to the reflection optical sensor 150, may be provided at a position facing each of the photosensitive members 1Y, 1M, 1C and 1K. In this case, a total of four reflection optical sensors 150X are provided for the four photosensitive members 1Y, 1M, 1C and 1K, respectively. Also in this case, as shown in FIG. 10B, the reflection optical sensor 150X may be provided at a position facing an image forming area of each of the photosensitive members 1Y, 1M, 1C and 1K, and a second reflection optical sensor 150XA, corresponding to the second reflection optical sensor 150A, may be provided at a position facing an image not-forming area A12 of each of the photosensitive members 1Y, 1M, 1C and 1K, the same as the case of FIG. 10A. In the case where the reflection optical sensors (150X or 150X and 150XA) are provided to face the photosensitive members 1Y, 1M, 1C and 1K, respectively, fog detection is carried out as the reflection optical sensor (150X or 150X and 150XA) detects the fog detecting image formed on each of the photosensitive members 1Y, 1M, 1C and 1K, and thus, it is not necessary to drive the intermediate transfer belt 15. Thus, it is possible to avoid deterioration of the intermediate transfer belt 15. It is noted that in FIG. 10B, M2 denotes a direction in which the surface of each of the photosensitive members 1Y, 1M, 1C and 1K shown in FIG. 10B moves as the photosensitive member is rotated about its rotation axis.

Next, a verification experiment will be described.

Materials of toner used in the verification experiment are as follows:

Polyester resin A (softening point: 131° C., AV value (acid value): 25) . . . 68 parts Polyester resin B (softening point: 116° C., AV value (acid value): 1.9) . . . 32 parts Master batch of cyan (containing 50 parts of Pigment Blue 15:3) . . . 8 parts Carnauba wax . . . 8 parts The above-mentioned toner materials were sufficiently mixed by a Henschel mixer; after that, by using a two-axis kneading and extruding machine (PCM-30 manufactured by IKEGAI CORPORATION) after an ejecting part thereof was removed, were melted and kneaded, then, the obtained mixture was rolled by using a cooling press roller into 2 mm thickness, was cooled by a cooling belt, and after that, was crushed coarsely by a feather mill. After that, a mechanical grinder (KTM manufactured by KAWASAKI HEAVY INDUSTRY LTD.) was used to crush the material into an average grain size of 10 through 12 μm. Further, a jet grinder (IDS manufactured by NIPPON PNEUMATIC MFG. CO., LTD.) was used to crush the material, and classify and remove coarse grains from the material, and after that, a rotor classifier (Teeplex classifier, type: 100ATP, manufactured by HOSOKAWA MICRON CORPORATION) was used to classify the classified fine grains, and thus, a toner parent body A having a volume mean grain size (volume mean diameter) of 7.9 μm and having an average circularity of 0.910 was obtained. 1 part of silica (RX200) was added to 100 parts of the toner parent body A, a Henschel mixer was used to carry out mixing the material at a circumferential velocity of 40 m/s, for 5 minutes, and thus, toner was produced.

The thus-produced toner was supplied to a printer, Ipsio C220; an endurance test was carried out, at a room temperature, in a manner of 1 sheet/1 job, 3 seconds intermittent, and 3000 sheets/5000 sheets. After that, the toner was extracted from a developing apparatus. The extracted toner was used as the old toner in the developing apparatus, the new toner was used as toner being supplied, plural mixed toners were produced having mutually different mixture ratios, a blank paper image was formed on a photosensitive member, and a toner amount level (fog amount) on the photosensitive member was measured. The result is shown in FIG. 8.

Figure 8:
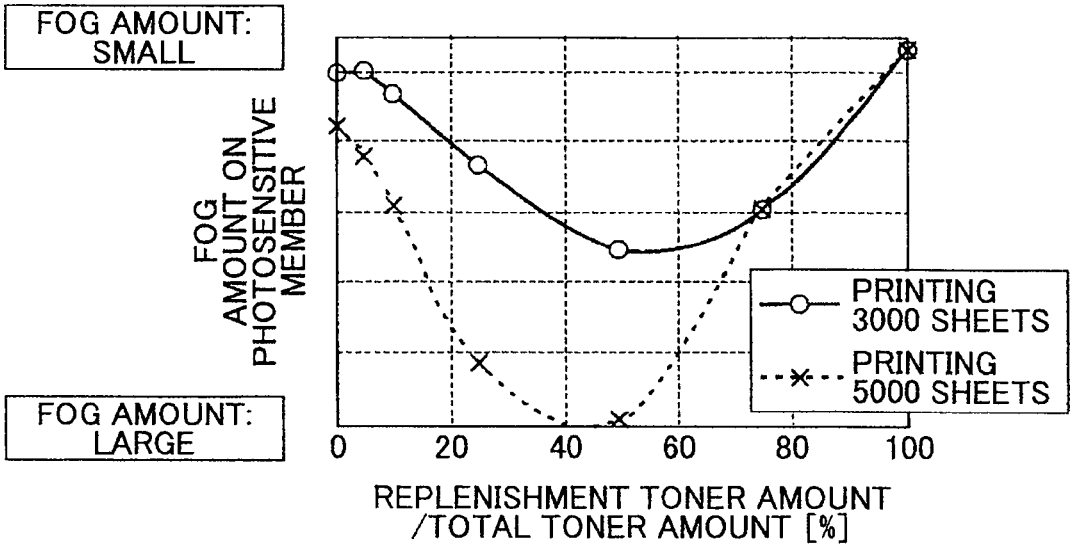
FIG. 8 shows a graph showing a result of a verification experiment.

As shown in FIG. 8, it is seen that, in a case where toner, after the endurance test of 3000 sheets was carried out, was used as the old toner, a deterioration level of the old toner was low, and therefore, a level of fog amount was smaller even in a case where the old toner was mixed with new toner. On the other hand, it is seen that, in a case where toner, after the endurance test of 5000 sheets was carried out, was used as the old toner, a deterioration level of the old toner was high, and therefore, a level of fog amount became considerably worse in a case where the old toner was mixed with new toner. This is because as described above, charge separation occurred because of rubbing the new toner and the deteriorated old toner together, thus electrons were removed from the deteriorated old toner; and as a result, the deteriorated old toner became weak-electrified or reverse-electrified. Therefrom, it is seen that in a case where toner that is deteriorated and is not easily electrified exists, it is possible to obtain satisfactory image quality after new toner is supplied, as a result of the old toner remaining in a developing apparatus being ejected and thus almost all of the old toner being removed, and then, the new toner being supplied.

Figure 9:
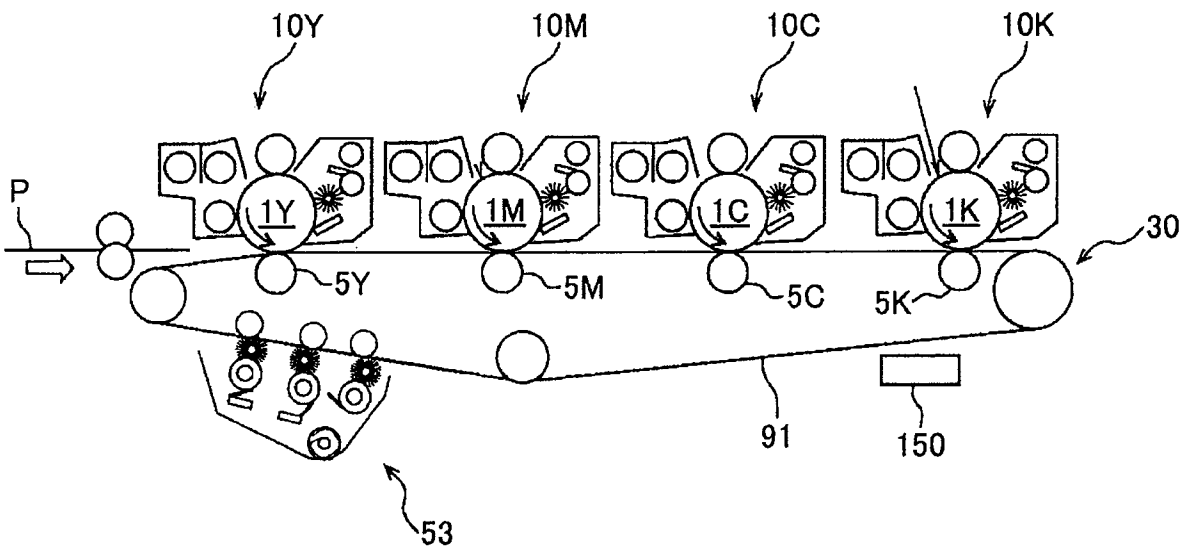
FIG. 9 shows a general partial configuration of a tandem-type direct-transfer-type printer.

Further, in the above description, the example in which the present invention is applied to the image forming apparatus according to the intermediate transfer system (see FIG. 1A) has been described. However, the embodiment is not limited, and as shown in FIG. 9, the present invention may also be applied to an image forming apparatus according to a direct transfer system. In the image forming apparatus according to the direct transfer system of FIG. 9, a transfer unit 30 that is a transferring part includes a paper conveyance belt 91 as an endless moving member. The paper conveyance belt 91 is in contact with photosensitive members 1Y, 1M, 1C and 1K, respectively, and provides primary transfer nips for the colors Y, M, C and K, respectively. Then, during a process in which the paper conveyance belt 91 conveys transfer paper P from the left side to the right side of FIG. 9 along with its own endless moving operation as the paper conveyance belt 91 holds the transfer paper P on a surface of the paper conveyance belt 91, the paper conveyance belt 91 feeds the transfer paper P to the primary transfer nips for the colors Y, M, C and K, in sequence. Thus, Y, M, C and K toner images are primarily transferred to the transfer paper P as the Y, M, C and K toner images are superposed. On the downstream side in the belt moving direction of the primary transfer nip of the color K, a reflection optical sensor 150 is disposed, and the same as the above described embodiment of FIG. 1A, a blank paper image is transferred to the paper conveyance belt 91 in a case where a toner remaining amount in a developing apparatus becomes less than a predetermined toner amount value, and the reflection optical sensor 150 is used to detect toner in the blank paper image. Then, when fog in the blank paper image exceeds a threshold according to the detection result of the reflection optical sensor 150, a toner ejecting process is carried out before new toner is supplied to the developing apparatus. Toner ejected from the developing apparatus is transferred to the paper conveyance belt 91, and is removed by a belt cleaning apparatus 33 that cleans the paper conveyance belt 91 or is removed by a drum cleaning apparatus corresponding to the color of the ejected toner.

Thus, the image forming apparatus according to the present embodiment includes the photosensitive members 1Y, 1M, 1C and 1K that are latent image carrying members for carrying latent images; the electrifying apparatuses 2Y, 2M, 2C and 2K that are electrifying parts for electrifying the surfaces of the photosensitive members 1Y, 1M, 1C and 1K; the exposure apparatus 130 that is a latent image writing part for writing the latent images to the photosensitive members 1Y, 1M, 1C and 1K; the developing apparatuses 4Y, 4M, 4C and 4K that are developing parts for obtaining toner images by developing the latent images on the photosensitive members 1Y, 1M, 1C and 1K by respective toners; and the intermediate transfer belt 15 that is an endless moving member for moving a surface thereof in an endless manner or the transfer unit 30 as a transferring part for transferring the toner images on the photosensitive members 1Y, 1M, 1C and 1K to transfer paper as a recording member held on the surface of the paper conveyance belt 91. Further, the image forming apparatus further includes the toner containers 7Y, 7M, 7C and 7K that hold new toners to be supplied to the developing apparatuses 4Y, 4M, 4C and 4K; the remaining amount detecting parts (including the combinations of the transmission optical sensors (81K in the example of the developing apparatus 4K) and the control unit 90) for detecting toner remaining amounts in the developing apparatuses 4Y, 4M, 4C and 4K; and the toner supplying parts (including the control part 90 and the conveying parts (71*b*K in the example of the developing apparatus 4K)) for supplying the new toners from the toner storage parts (71K in the example of the developing apparatus 4K) to the developing apparatuses 4Y, 4M, 4C and 4K when the remaining amount detecting parts detect that the toner amounts in the developing apparatuses 4Y, 4M, 4C and 4K are equal to or less than the predetermined toner amount values. Further, when the remaining amount detecting parts detect that the toner amounts in the developing apparatuses 4Y, 4M, 4C and 4K are equal to or less than the predetermined toner amount values, blank paper images that are fog detecting images are formed, and the fog detecting part (including the reflection optical sensor 150 and the control part 90) detects in the blank paper images. Then, in cases where fog in the blank paper images exceeds the predetermined fog values, the control part 90 as a determining part carries out the toner ejecting processes of ejecting old toners remaining in the developing apparatus 4Y, 4M, 4C and 4K to the photosensitive members 1Y, 1M, 1C and 1K, before supplying the new toners to the developing apparatuses 4Y, 4M, 4C and 4K. On the other hand, in cases where fog in the blank paper images is equal to or less than the predetermined fog values, the control part 90 does not carry out the toner ejecting processes, and supplies the new toners to the developing apparatuses 4Y, 4M, 4C and 4K.

By providing the configuration, it is possible to prevent fog occurring after new toner is supplied, and also, it is possible to avoid useless toner consumption.

Further, the fog detecting part may detect fog in the fog detecting image based on a detection result (Vsp_dif) of the blank paper image that is the fog detecting image obtained by the reflection optical sensor 150 as a first optical detecting part that is disposed to face the image forming area (A1 shown in FIG. 10A) of the intermediate transfer belt 15 and optically detects in the surface of the intermediate transfer belt 15; and a detection result (Vsp_dif') of the image not-forming area (A2 shown in FIG. 10A) of the intermediate transfer belt 15 obtained by the second reflection optical sensor 150A as a second optical detecting part that is disposed to face the image not-forming area A2 of the intermediate transfer belt 15 and optically detects in the surface of the intermediate transfer belt 15. As a result of the image not-forming area A2 of the intermediate transfer belt 15 being detected by the second reflection optical sensor 150A, it is possible to detect a variation in a gloss level of the surface of the intermediate transfer belt 15 occurring because of deterioration of the surface of the intermediate transfer belt 15. Therefore, by using the detection result (Vsp_dif') of the image not-forming area A2 of the intermediate transfer belt 15 obtained by the second reflection optical sensor 150A, it is possible to remove an error component generated because of the variation in the gloss level of the surface of the intermediate transfer belt 15 because of deterioration, included in the detection result (Vsp_dif) of the blank paper image obtained by the reflection optical sensor 150. Specifically, the detection result (Vsp_dif') of the image not-forming area A2 of the intermediate transfer belt 15 obtained by the second reflection optical sensor 150A is subtracted from the detection result (Vsp_dif) of the blank paper image obtained by the reflection optical sensor 150. Thereby, even when the gloss level on the surface of the intermediate transfer belt 15 varies because of deterioration thereof, it is possible to avoid a variation in fog detection result occurring because of the influence of the variation in the gloss level on the surface of the intermediate transfer belt 15, and it is possible to obtain a satisfactory fog detection result through aging. It is noted that in FIG. 10A, M1 denotes a direction corresponding to the direction C shown in FIG. 1A, in which direction the surface of the intermediate transfer belt 15 moves as the intermediate transfer belt 15 operates as the endless moving member.

It is also possible to detect fog based on a detection result (Vsp_dif) of the blank paper image that is the fog detecting image obtained by the reflection optical sensor 150 as an optical detecting part that is disposed to face the image forming area (A1 shown in FIG. 10A) of the intermediate transfer belt 15 and optically detects toner in the surface of the intermediate transfer belt 15; and a detection result (Vsp_dif') of the intermediate transfer belt 15 obtained by the reflection optical sensor 150 after the contact/apart mechanism as a contact/apart part causes the intermediate transfer belt 15 to be apart from the photosensitive member(s). Toner hardly adheres to the image forming area A1 of the intermediate transfer belt 15 after the intermediate transfer belt 15 is removed from the photosensitive member(s). Therefore, by detecting toner in the intermediate transfer belt 15 by the reflection optical sensor 150 after the intermediate transfer belt 15 is removed from the photosensitive member(s), it is possible to detect a variation in a gloss level of the surface of the intermediate transfer belt 15 occurring because of deterioration of the surface of the intermediate transfer belt 15. Therefore, the same as the above description, by subtracting the detection result (Vsp_dif') after the intermediate transfer belt 15 is removed from the photosensitive member(s) from the detection result (Vsp_dif) of the blank paper image, it is possible to remove an error component generated because of the variation in the gloss level of the surface of the intermediate transfer belt 15 occurring because of deterioration, included in the detection result (Vsp_dif) of the blank paper image obtained by the reflection optical sensor 150.

Further, the voltage applying part (power source 110) is controlled so that the electric potential difference, at a time of the toner ejecting process, between the toner supply roller (42K in the example of the developing apparatus 4K) as a toner supply member and the developing roller (41K in the example of the developing apparatus 4K) as a toner carrying member becomes larger than the electric potential difference at a time of a developing operation. Thereby, it is possible to increase a toner amount to be supplied to the developing roller from the toner supply roller at a time of the toner ejecting process, and it is possible to effectively eject old toner remaining in the developing apparatus from the developing roller.

Further, the intermediate transfer belt may be made to be apart from the photosensitive members by the contact/apart mechanism at a time when the toner ejecting process is carried out. Thereby, at a time when the toner ejecting process is carried out, the intermediate transfer belt is prevented from rubbing on the cleaning member of the belt cleaning apparatus and the photosensitive members, and thus, it is possible to avoid deterioration of the intermediate transfer belt occurring because of rubbing.

Further, in the toner containers (7Y, 7M, 7C, 7K), the waste toner receiving parts (72K in the example of the toner container 7K) as removed toner containers are provided for holding waste toners that are removed toners removed by the drum cleaning apparatuses that are toner removing parts. Thereby, when new toners in the toner containers run out, it is possible to collect waste toners at the same time when the toner containers are replaced by other toner containers that hold new toners.

Further, it is possible to terminate the toner ejecting process at a timing at which a shortage of toner occurs in the developing area, as a result of the toner ejecting process being terminated based on a driving time period of the developing apparatus elapsing since the toner ejecting process is started. In this control method, it is possible to prevent deterioration of the photosensitive members and the intermediate transfer belt 15 occurring because of rubbing, in comparison to the case where the reflection optical sensor 150 is used to detect a density of toner of an ejected image adhering to the intermediate transfer belt 15, and when a detection result of the density of toner of the ejected image becomes equal to or less than the predetermined toner density value, the toner ejecting process is terminated.

Further, it is not necessary to carry out an electrifying process of the surface of the photosensitive member by the electrifying apparatus at a time when the toner ejecting process is carried out. Although the electrifying process of the surface of the photosensitive member by the electrifying apparatus is not carried out, it is possible to create an electric field such that toner on the developing roller electrostatically moves to the photosensitive member, as a result of a developing bias being applied to the developing roller. Thus, it is possible to eject old toner remaining in the developing apparatus from the developing roller to the photosensitive member. Thereby, it is possible to prevent deterioration occurring because of light-induced fatigue, in comparison to a case where, at a time when the toner ejecting process is carried out, the photosensitive member is electrified by the electrifying apparatus, the entire surface of the photosensitive member is exposed by the exposure apparatus, and toner on the developing roller is caused to move to the photosensitive member.

Further, it may be determined that a toner amount in the developing apparatus is equal to or less than the predetermined toner amount value when, after the transmission optical sensor that is a height detecting part that detects a height of toner held in the developing apparatus detects that the height of the toner becomes equal to or less than the predetermined height value, the number of dots included in an image to be output is counted, and the counted number becomes equal to or more than the predetermined number value. By the control method, it is possible to reduce the remaining toner in the developing apparatus to just such an amount that an image density becomes equal to or less than the predetermined density value because of lack of the toner amount remaining in the developing apparatus, and thus, it is possible to reduce the ejected toner amount to the minimum necessary amount.

The present invention is not limited to the specifically disclosed embodiments, and variations and modifications may be made without departing from the scope of the present invention.

The present application is based on Japanese Priority Application No. 2010-026413, filed on Feb. 9, 2010, the entire contents of which are hereby incorporated herein by reference.

What is claimed is:

1. An image forming apparatus comprising:

a latent image carrying member that carries a latent image;

an electrifying part that electrifies a surface of the latent image carrying member;

a latent image writing part that writes the latent image on the latent image carrying member;

a developing part that develops the latent image on the latent image carrying member by using toner and obtains a toner image;

a transferring part that transfers the toner image on the latent image carrying member to a surface of an endless moving member in which the surface is moved in an endless manner or a recording member held on the surface of the endless moving member;

a toner container that holds the toner to be supplied to the developing part;

a remaining amount detecting part that detects a toner remaining amount in the developing part;

a toner supplying part that supplies the toner to the developing part from the toner container when the remaining amount detecting part detects that the toner remaining amount in the toner developing part is equal to or less than a predetermined toner amount value;

a fog detecting part that detects fog of an image; and a determining part that, when the remaining amount detecting part detects that the remaining toner amount in the developing part is equal to or less than the predetermined toner amount value, forms a fog detecting image, the fog detecting image being detected by the fog detecting part, and determines, based on a detection result of the fog detecting part for the fog detecting image, whether a toner ejecting process of ejecting the toner remaining in the developing part to the latent image carrying member is carried out before supplying the toner to the developing part by the toner supplying part.

2. The image forming apparatus as claimed in claim 1, wherein in a case where the fog detecting part detects fog exceeding a predetermined fog value, the toner ejecting process is carried out.

3. The image forming apparatus as claimed in claim 1, wherein the fog detecting part includes a first optical detecting part that is disposed to face an image forming area of the endless moving member or the latent image carrying member and optically detects toner in a surface of the image forming area, and a second optical detecting part that is disposed to face an image not-forming area of the endless moving member or the latent image carrying member and optically detects toner in a surface of the image not-forming area, wherein the fog detecting part detects fog of the fog detecting image based on a detection result of the first optical detecting part for the fog detecting image and a detection result of the second optical detecting part for the image not-forming area.

4. The image forming apparatus as claimed in claim 1, wherein the developing part includes a toner carrying member that faces the latent image carrying member and carries the toner; a toner supply member that is in contact with an outer circumferential surface of the toner carrying member; and a voltage applying part that applies a voltage to the toner supply member for generating such an electric potential difference between the outer circumferential surface of toner carrying member and the toner supply member that the toner moves from the toner supply member to the toner carrying member, and controls the voltage applying part so that the electric potential difference between the toner supply member and the toner carrying member becomes greater at a time of the toner ejecting process than at a time of a developing operation.

5. The image forming apparatus as claimed in claim 1, further comprising a contact/apart part that causes the endless moving member to come into contact with and to be apart from the latent image carrying member, wherein at a time of execution of the toner ejecting process, the endless moving member is caused to be apart by the contact/apart part from the latent image carrying member.

6. The image forming apparatus as claimed in claim 1, further comprising a toner removing part that removes the toner remaining on the surface of the latent image carrying member after a transfer process has been carried out by the transferring part, wherein the toner container includes a removed toner container that receives the toner removed by the toner removing part.

7. The image forming apparatus as claimed in claim 1, wherein the toner ejecting process is terminated based on a time period during which the developing part is driven from a time at which the toner ejecting process is started.

8. The image forming apparatus as claimed in claim 1, wherein in a time period during which the toner ejecting process is carried out, an electrifying process of electrifying the surface of the latent image carrying member by the electrifying part is not carried out.

9. The image forming apparatus as claimed in claim 1, wherein the remaining amount detecting part includes a height detecting part that detects a height of the toner held in the developing part, wherein after the height detecting part detects that the height of the held toner is equal or less than a predetermined height value, the number of dots of an output image are counted, and when the counted number reaches a predetermined number, the remaining amount detecting part detects that the toner amount in the developing part is equal to or less than the predetermined toner amount value.

10. The image forming apparatus as claimed in claim 1, further comprising a process cartridge that supports as a unit at least the latent image carrying member, the electrifying part and the developing part in a manner such that the process cartridge is detachable from an apparatus body.

11. A toner supply method for supplying toner from a toner container to a developing part that causes toner to adhere to a latent image formed on a latent image carrying member and develops the latent image, the method comprising:

detecting a toner amount in the developing part as being equal to or less than a predetermined toner amount value;

forming a fog detecting image in a case where the toner amount in the developing part is equal to or less than the predetermined toner amount value, and detecting fog; and determining based on the detected fog whether to execute a toner ejecting process of ejecting the toner remaining in the developing part toward the latent image carrying member before supplying the toner to the developing part from the toner container.

* * * * *